US008545052B2

(12) United States Patent
Hu

(10) Patent No.: US 8,545,052 B2
(45) **Date of Patent: *Oct. 1, 2013**

(54) HIGH ILLUMINATION LED BULB WITH 360-DEGREE FULL EMISSION ANGLE

(76) Inventor: Wen-Sung Hu, Rende Township, Tainan County (TW)

( * ) Notice: Subject to any disclaimer, the term of this patent is extended or adjusted under 35 U.S.C. 154(b) by 26 days.

This patent is subject to a terminal disclaimer.

(21) Appl. No.: 12/876,212

(22) Filed: Sep. 6, 2010

(65) Prior Publication Data

US 2012/0056542 A1 Mar. 8, 2012

(51) Int. Cl.
*F21V 21/00* (2006.01)

(52) U.S. Cl.
USPC ..... 362/249.02; 362/310; 362/800

(58) Field of Classification Search
USPC ..... 362/249.02, 310, 800; 313/318.01
See application file for complete search history.

(56) References Cited

U.S. PATENT DOCUMENTS 4,056,718 A * 11/1977 Faux et al. ..... 362/306
5,806,965 A * 9/1998 Deese ..... 362/249.04
7,122,754 B2 * 10/2006 Endres et al. ..... 200/339
7,960,872 B1 * 6/2011 Zhai et al. ..... 307/157
7,963,686 B2 * 6/2011 Hu ..... 362/547
7,976,187 B2 * 7/2011 Villard ..... 362/246
7,976,211 B2 * 7/2011 Cao ..... 362/650
2006/0232974 A1 * 10/2006 Lee et al. ..... 362/294

* cited by examiner

*Primary Examiner* — Jong-Suk (James) Lee
*Assistant Examiner* — Mark Tsidulko
(74) *Attorney, Agent, or Firm* — Alan Kamrath; Kamrath IP Lawfirm, P.A.

(57) ABSTRACT

A high illumination LED bulb with a 360-degree full emission angle includes a transparent lamp seat, a transparent lampshade coupled to lamp seat, a support board disposed in a chamber defined by transparent lamp seat and transparent lampshade, a heat dissipating body supported by support board, and first and second light emitting modules. The first light emitting module includes a first substrate disposed on a face of heat dissipating body and at least one LED disposed on the first substrate. The second light emitting module includes a second substrate disposed on another face of the heat dissipating body and at least one LED disposed on the second substrate. The LEDs on first and second substrates can project upper and lower projection lights respectively, and a reflected halo formed by projection of the upper projection light on the transparent lampshade can form a side projected halo. Thereby, a 360-degree full emission angle projected halo can be formed.

8 Claims, 8 Drawing Sheets

HIGH ILLUMINATION LED BULB WITH 360-DEGREE FULL EMISSION ANGLE

BACKGROUND OF THE INVENTION

1. Field of the Invention

The present invention relates to a bulb, and, more particularly, to a high illumination LED bulb with a 360-degree full emission angle.

2. Description of the Related Art

As the green energy policy is highly promoted in international society, many advanced countries have thus set up the utilization deadline for tungsten bulbs. Light-emitting diode (LED) bulbs thus gradually enter the replacement market of tungsten bulbs.

The optical source of traditional tungsten bulbs projects a 360-degree light, but bulbs 2, 3, 4 (as shown in FIGS. 1-3) currently based on LED (Surface-Mount Device LED or chip) as an optical source can only make projection light in a single direction. The LED bulbs 2, 3, 4 of a single direction projection light can be only utilized in a type of lamp with illumination from the ceiling to the floor (DOWN LIGHT). If the LED bulbs 2, 3, 4 are to be used in a standing lamp 5 (see FIG. 13), a desk lamp 6 (see FIG. 14), a wall lamp 7 (see FIG. 15) or a bed lamp, the projection direction can be only toward the ceiling (see 01 of FIG. 4). The projection light toward the floor can only rely on the reflected light shined on the slope of the lampshade of the standing lamp, desk lamp, wall lamp or bed lamp (see 02 of FIG. 4). The illumination is obviously insufficient. Thus, after tungsten bulbs disappear in the market, such types of lamps will all be replaced by energy saving bulbs such as hot cathode fluorescent lamps (HCFL) or cold cathode fluorescent lamps (CCFL).

However, HCFL and CCFL type energy saving bulbs have ultraviolet light, electromagnetic waves and radiation, which are harmful to the human body. Hence, if they are used close to the human body, injury will be larger. Furthermore, they contain compositions such as Hg, Ar and Ne. Hg is harmful to the human's brain, kidney and skin and is a contaminating material to the land too. Further, since the lamp bodies of HCFL, CCFL are usually of glass material, which is very fragile, when they are broken, Hg metal might get released. Once Hg is contacted by human bodies or is inhaled by a human, it will cause brain and kidney disease. Moreover, it takes great cost to decompose the toxicity of the rejected product of HCFL, CCFL, and it does not meet environmental requirements too. In addition, similar to fluorescent lamps, discharge of HCFL and CCFL type bulbs is a result of the impact of the electrode with Hg gas. The generated light beam is of discontinuous light, which will cause vision fatigue of the eye and does not facilitate reading.

Thus, how to design LED bulbs to match the utilization of lamps such as standing lamps, desk lamps, wall lamps or bed lamps and to increase the illumination scope of the projection light is really the top urgent matter of the LED industries. Also, it is an important way to promote the concept of environmental protection and energy saving.

BRIEF SUMMARY OF THE INVENTION

Therefore, it is an objective of the present invention to overcome the aforementioned shortcoming and deficiency of the prior art by providing a high illumination LED bulb with a 360-degree full emission angle. The high illumination LED bulb includes a transparent lamp seat having spaced lower and upper ends. A lamp head is mounted to the lower end of the transparent lamp seat, an opening is formed in the upper end of the transparent lamp seat, and a driver is mounted in the transparent lamp seat. The high illumination LED bulb further includes a transparent lampshade engaged with the upper end of the transparent lamp seat and covering the opening of the transparent lamp seat. The transparent lampshade and the transparent lamp seat together define a chamber therein. A support board is supported in the chamber and includes an upper end face facing the transparent lampshade and a lower end face facing the lamp head. A heat dissipating body is received in the chamber and supported by the support board. The heat dissipating body includes an upper surface facing the transparent lampshade and a lower surface facing the lamp head. A first light emitting module is disposed on the upper surface of the heat dissipating body and includes at least one first LED. The first light emitting module is electrically connected to the driver so that the first LED can be driven to project light beams towards the transparent lampshade. A second light emitting module is disposed on the lower surface of the heat dissipating body and includes at least one second LED. The second light emitting module is electrically connected to the driver so that the second LED can be driven to project light beams towards the transparent lamp seat. The first and second LEDs can respectively project upper and lower projection lights, and side projection halos between the upper and lower projection lights are provided by a reflected halo formed by projection of the upper projection light on the transparent lampshade. Thereby, a 360° full emission angle projection halo can then be formed.

The high illumination LED bulb can be used in standing lamps, desk lamps, wall lamps, bed lamps, etc. to form a projection light with a full emission angle. Thus, the illumination effect needed by interior spaces can be formed, and the illumination needed for reading by the users can be achieved.

In a preferred form, the first light emitting module includes a first substrate mounted on the upper surface of the heat dissipating body, and the first LED is disposed on the first substrate. The second light emitting module includes a second substrate mounted on the lower surface of the heat dissipating body, and the second LED is disposed on the second substrate.

In a preferred form, the support board is a transparent support board. A ledge is formed on an inner wall of the upper end of the transparent lamp seat, and the support board is mounted on the ledge.

In a preferred form, the first substrate is integrally formed with the support board as a single member, and the first substrate is mounted on the ledge.

In a preferred form, the second substrate is integrally formed with the support board as a single member, and the second substrate is mounted on the ledge.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 5:
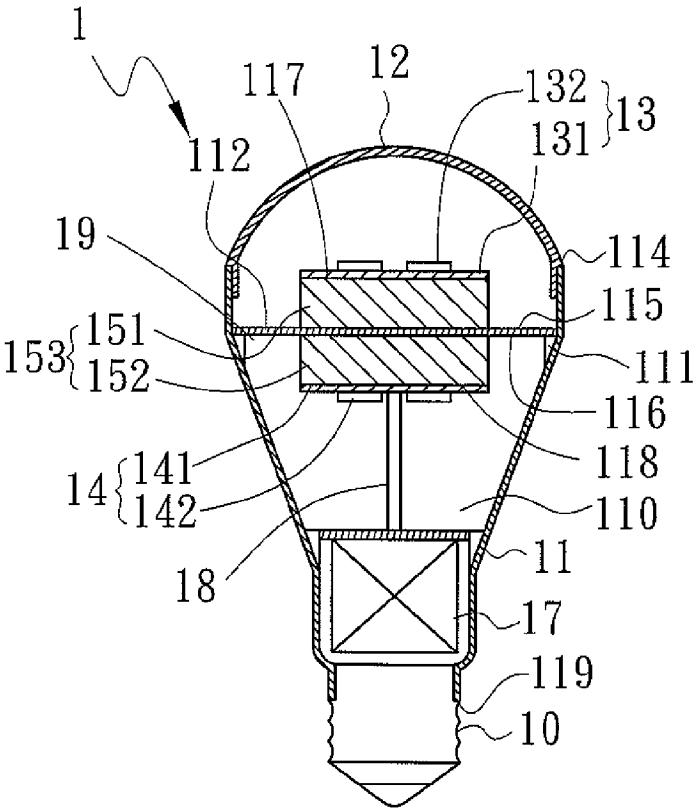
FIG. 5 is a cross sectional view of a LED bulb according to a first embodiment of the present invention.

A high illumination LED bulb of a first embodiment of the present invention is shown in FIG. 5 of the drawings and generally designated 1. The high illumination LED bulb 1 includes a transparent lamp seat 11, a transparent lampshade 12, a transparent support board 112, a heat dissipating body 153, a first light emitting module 13, and a second light emitting module 14. Transparent lamp seat 11 includes spaced lower and upper ends 119 and 114. A lamp head 10 is mounted to lower end 119 of transparent lamp seat 11, and an opening 19 is formed in upper end 114 of transparent lamp seat 11. Transparent lampshade 12 is engaged with upper end 114 of transparent lamp seat 11 and closes opening 19 so that transparent lamp seat 11 and transparent lampshade 12 together define a chamber 110 therein. A driver 17 is mounted in chamber 110. An annular ledge 111 is formed on an inner wall of upper end 114 of transparent lamp seat 11. Transparent support board 112 is mounted on ledge 111 so as to be supported within chamber 110. Further, transparent support board 112 includes upper end face 115 facing transparent lampshade 12 and lower end face 116 facing lamp head 10.

Heat dissipating body 153 is disposed in chamber 110 and supported by transparent support board 112. Heat dissipating body 153 includes upper surface 117 facing transparent lampshade 12 and lower surface 118 facing lamp head 10. In this embodiment, heat dissipating body 153 includes a first heat dissipating body 151 disposed on upper end face 115 of transparent support board 112 and a second heat dissipating body 152 disposed on lower end face 116 of transparent support board 112. First and second heat dissipating bodies 151 and 152 can be fixed to transparent support board 112 by fasteners such as screws (not shown). First light emitting module 13 includes a first substrate 131 and a plurality of first LEDs (SMD LED or chip) 132 disposed on first substrate 131. In this embodiment, first substrate 131 is mounted on upper surface 117 of first heat dissipating body 151. Second light emitting module 14 includes a second substrate 141 mounted on lower surface 118 of second heat dissipating body 152 and a plurality of second LEDs 142 (SMD LED or chip) disposed on second substrate 141. Furthermore, driver 17 is electrically connected to first and second light emitting modules 13 and 14 through conductive wires 18. Thus, first LEDs 132 can be driven and project light beams towards transparent lampshade 12, and second LEDs 142 can be driven and project light beams towards transparent lamp seat 11.

Figure 2:
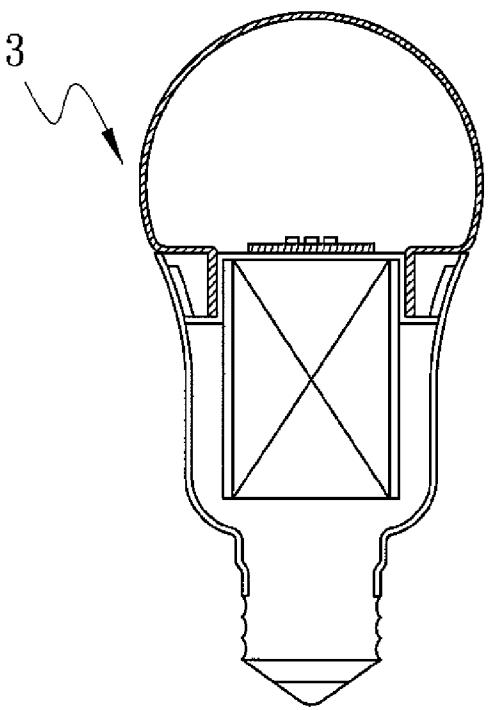
FIG. 2 Prior Art
FIG. 2 is a schematic view of a second conventional bulb.
Figure 1:
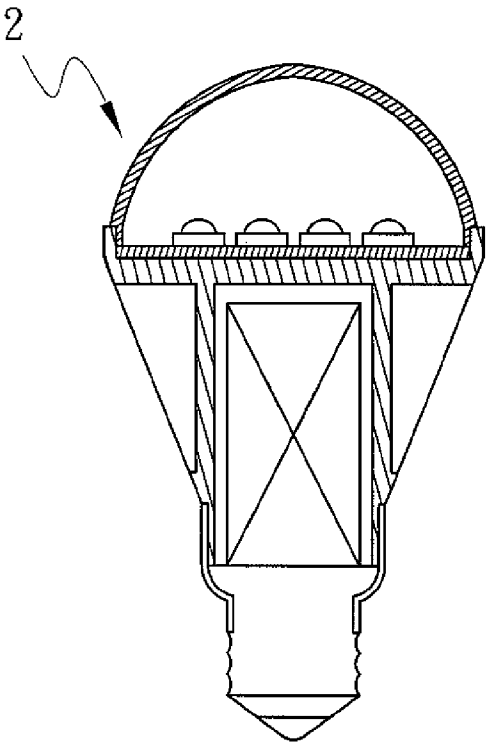
FIG. 1 Prior Art
FIG. 1 is a schematic view of a first conventional bulb.
Figure 4:
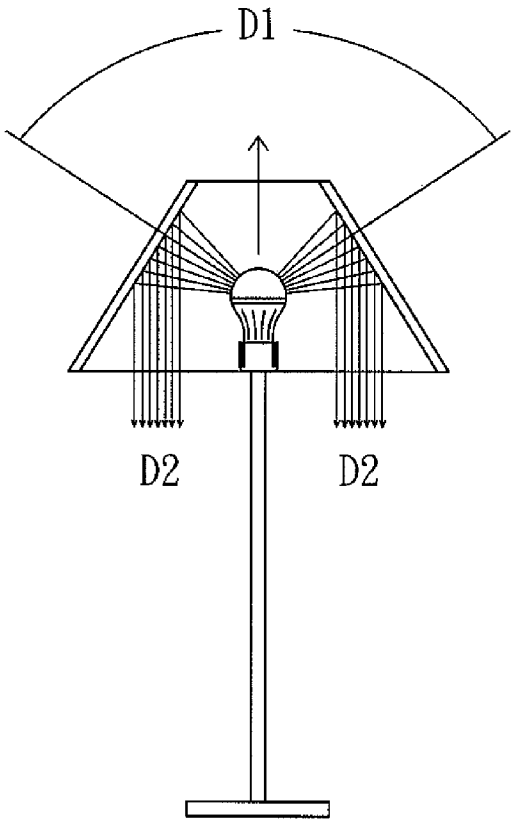
FIG. 4 Prior Art
FIG. 4 is an illustration of projection light of a conventional bulb used in a standing lamp.
Figure 3:
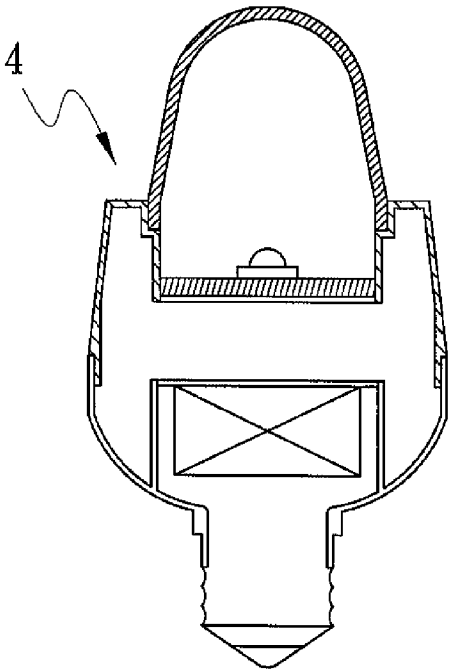
FIG. 3 Prior Art
FIG. 3 is a schematic view of a third conventional bulb.
Figure 6:
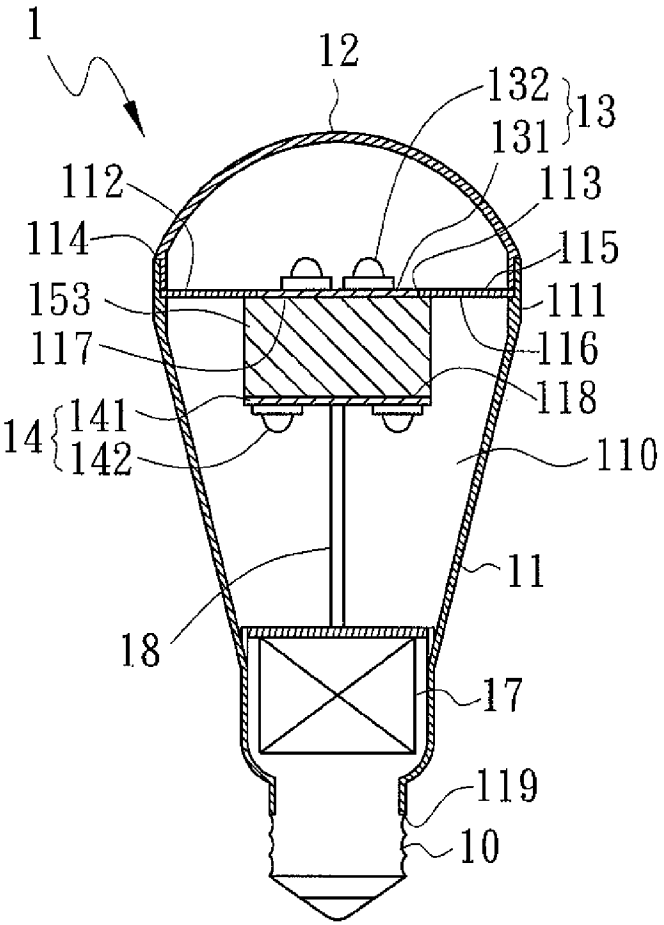
FIG. 6 is a cross sectional view of a LED bulb according to a second embodiment of the present invention.

FIG. 6 shows a high illumination LED bulb 1 of a second preferred embodiment of the present invention modified from the first embodiment. Description of the parts of high illumination LED bulb 1 shown in FIG. 6 identical to those shown in FIG. 5 is omitted. In particular, a hole 113 is provided in a center of transparent support board 112. Heat dissipating body 153 is disposed on lower end face 116 of transparent support board 112. Further, first substrate 131 and first LEDs 132 are disposed on upper surface 117 of heat dissipating body 153, second substrate 141 and second LEDs 142 are disposed on lower surface 118 of heat dissipating body 153, and first substrate 131 is located in hole 113 of transparent support board 112.

Figure 7:
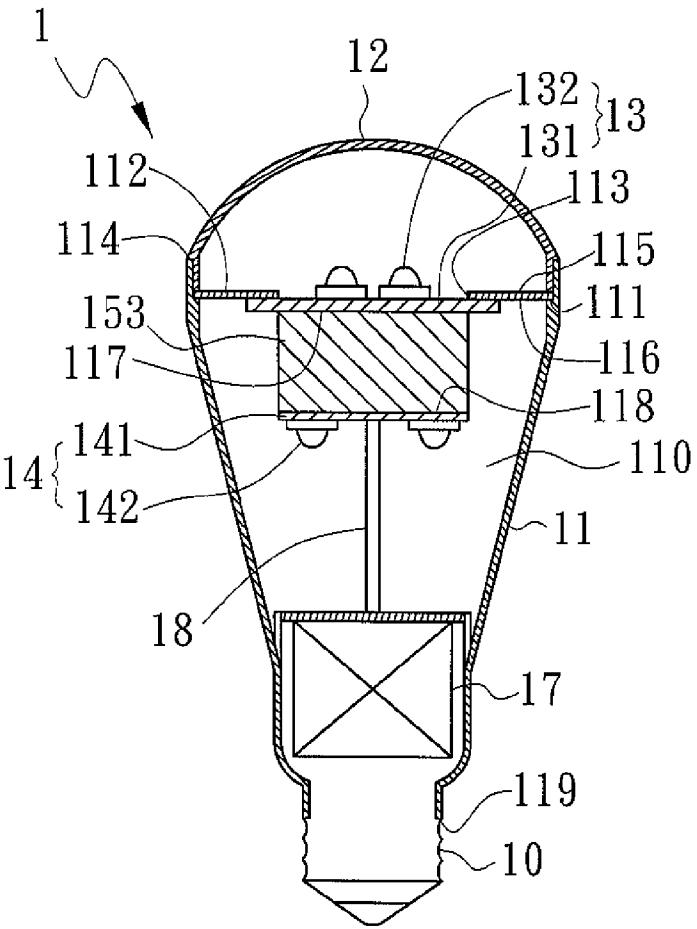
FIG. 7 is a cross sectional view of a LED bulb according to a third embodiment of the present invention.

FIG. 7 shows a high illumination LED bulb 1 of a third preferred embodiment of the present invention modified from the second embodiment. In this embodiment, first substrate 131 is disposed on lower end face 116 of transparent support board 112, and first LEDs 132 is disposed on first substrate 131 and located in hole 113 of transparent support board 112.

Figure 8:
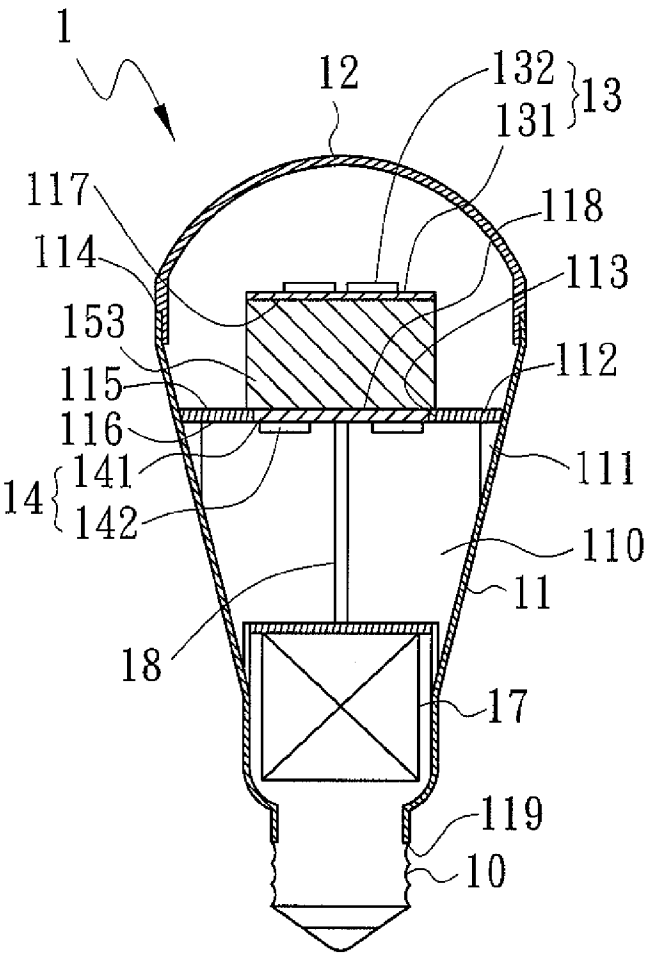
FIG. 8 is a cross sectional view of a LED bulb according to a fourth embodiment of the present invention.

FIG. 8 shows a high illumination LED bulb 1 of a fourth preferred embodiment of the present invention modified from the third embodiment. In this embodiment, heat dissipating body 153 is disposed on upper end face 115 of transparent support board 112. First and second substrates 131 and 141 are respectively disposed on upper and lower surfaces 117 and 118 of heat dissipating body 153. First and second LEDs 132 and 142 are respectively disposed on first and second substrates 131 and 141, and second substrate 141 is located in hole 113 of transparent support board 112.

Figure 9:
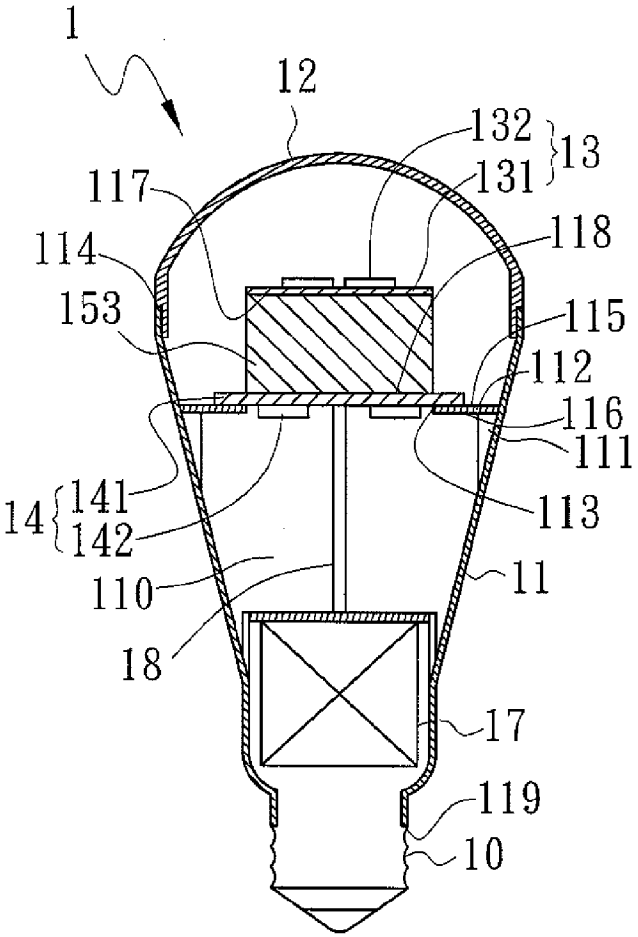
FIG. 9 is a cross sectional view of a LED bulb according to a fifth embodiment of the present invention.

FIG. 9 shows a high illumination LED bulb 1 of a fifth preferred embodiment of the present invention modified from the fourth embodiment. In this embodiment, second substrate 141 is disposed on upper end face 115 of transparent support board 112, and second LEDs 142 is disposed on second substrate 141 and located in hole 113 of transparent support board 112.

Figure 10:
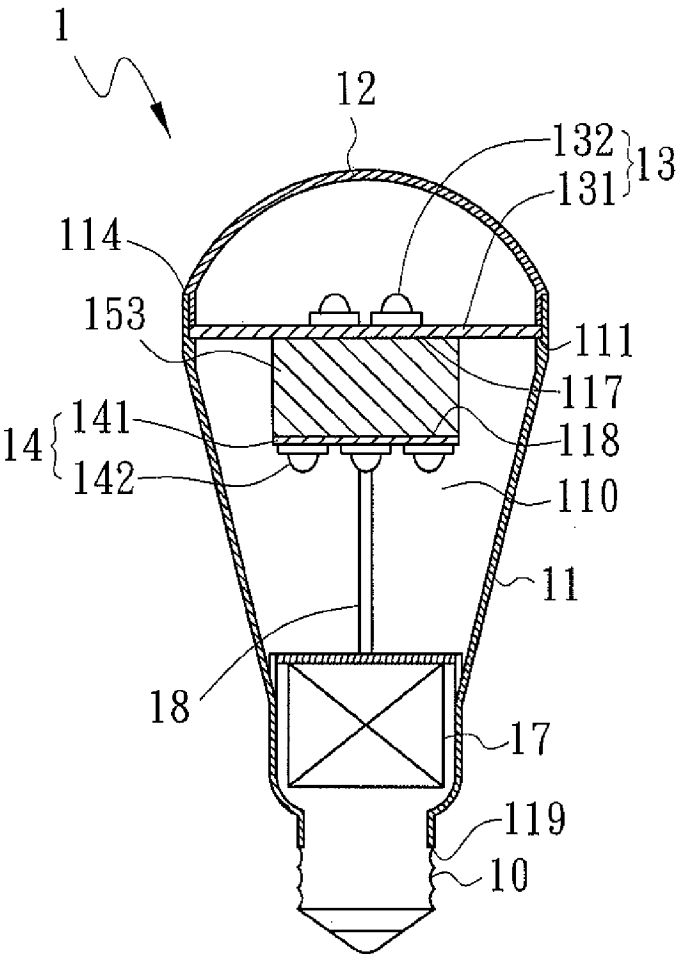
FIG. 10 is a cross sectional view of a LED bulb according to a sixth embodiment of the present invention.

FIG. 10 shows a high illumination LED bulb 1 of a sixth preferred embodiment of the present invention modified from the second embodiment. Description of the parts of high illumination LED bulb 1 shown in FIG. 10 identical to those shown in FIG. 6 is omitted. In particular, first substrate 131 serves as the transparent support board. That is, transparent support board 112 shown in FIG. 6 is integrally formed with first substrate 131 as a single member, and first substrate 131 is supported on the ledge 111. First substrate 131 is provided with first LEDs 132 and disposed on upper surface 117 of heat dissipating body 153. Second substrate 141 is provided with second LEDs 142 and disposed on lower surface 118 of heat dissipating body 153.

Figure 11:
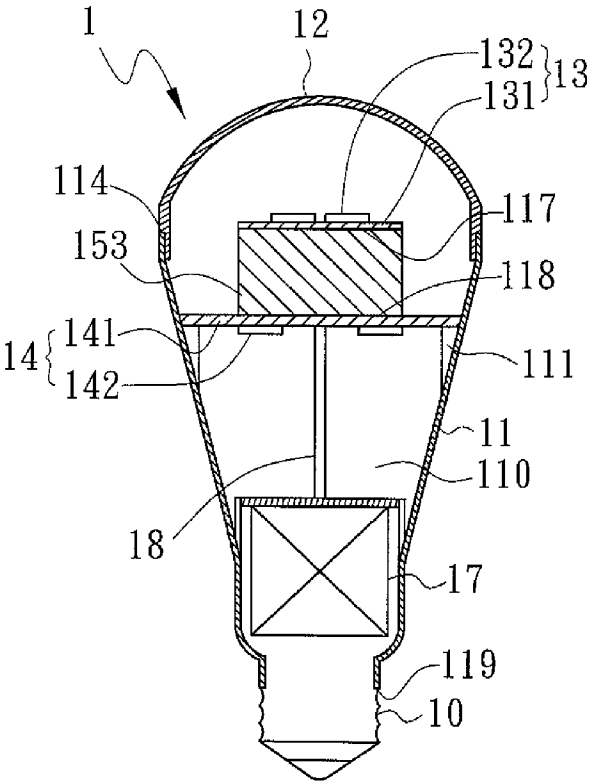
FIG. 11 is a cross sectional view of a LED bulb according to a seventh embodiment of the present invention.

FIG. 11 shows a high illumination LED bulb 1 of a seventh preferred embodiment of the present invention modified from the sixth embodiment. In this embodiment, second substrate 141 serves as the transparent support board and is supported on the ledge 111. First substrate 131 is provided with first LEDs 132 and disposed on upper surface 117 of heat dissipating body 153. Second substrate 141 is provided with second LEDs 142 and disposed on lower surface 118 of heat dissipating body 153.

Figure 12:
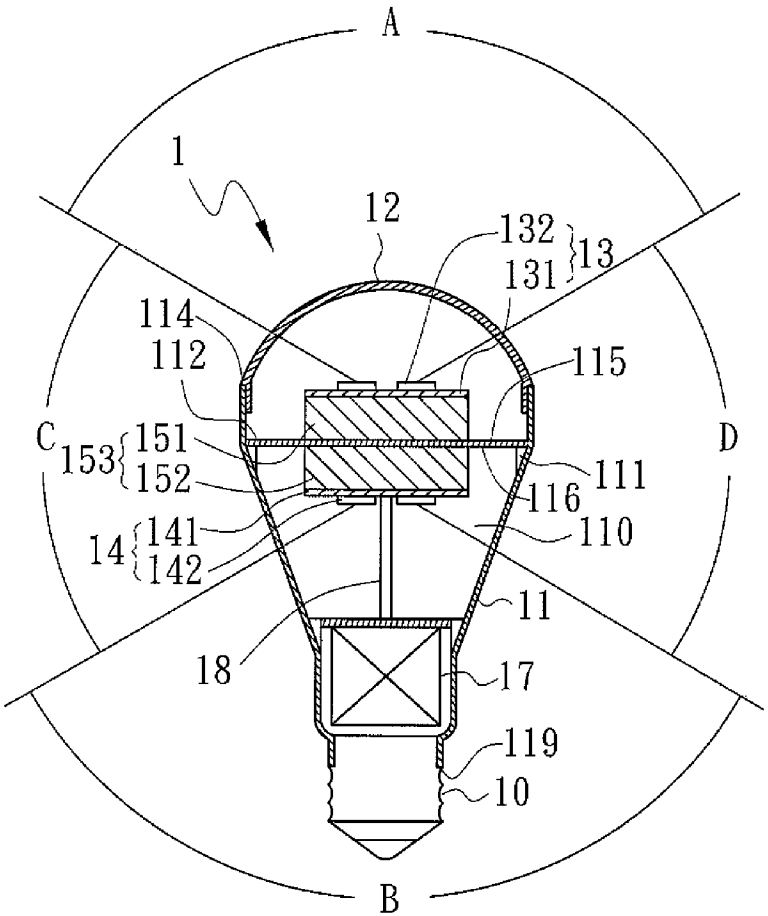
FIG. 12 is an illustration of projection light of the LED bulb of FIG. 5.

FIG. 12 is a light projection illustration of high illumination LED bulb 1 of the present invention. First and second LEDs 132 and 142 of first and second light emitting modules 13 and 14 respectively project upper projection light A and lower projection light B. Further, side projection halos C and D between upper and lower projection lights A and B are provided by a reflected halo formed by projection of the upper projection light A on transparent lampshade 12. Thereby a 360° full emission angle projection halo is formed.

Figure 14:
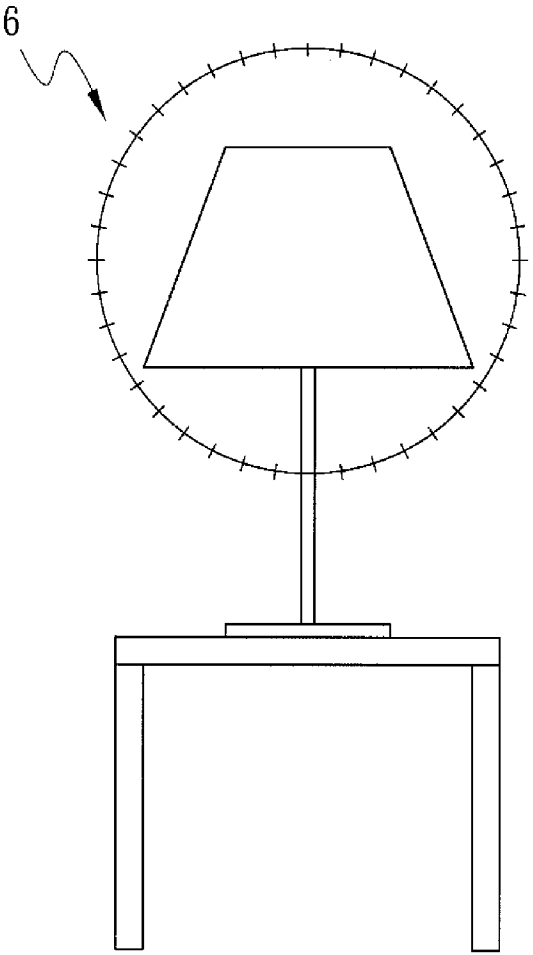
FIG. 14 shows a desk lamp and a 360-degree full emission angle projection of a LED bulb of the present invention used in the desk lamp.
Figure 13:
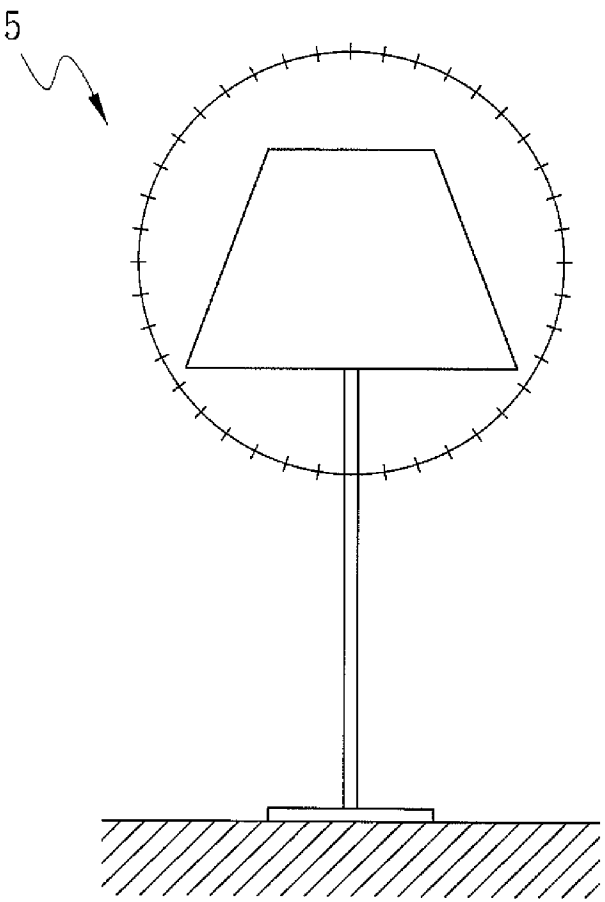
FIG. 13 shows a standing lamp and a 360-degree full emission angle projection of a LED bulb of the present invention used in the standing lamp.
Figure 16:
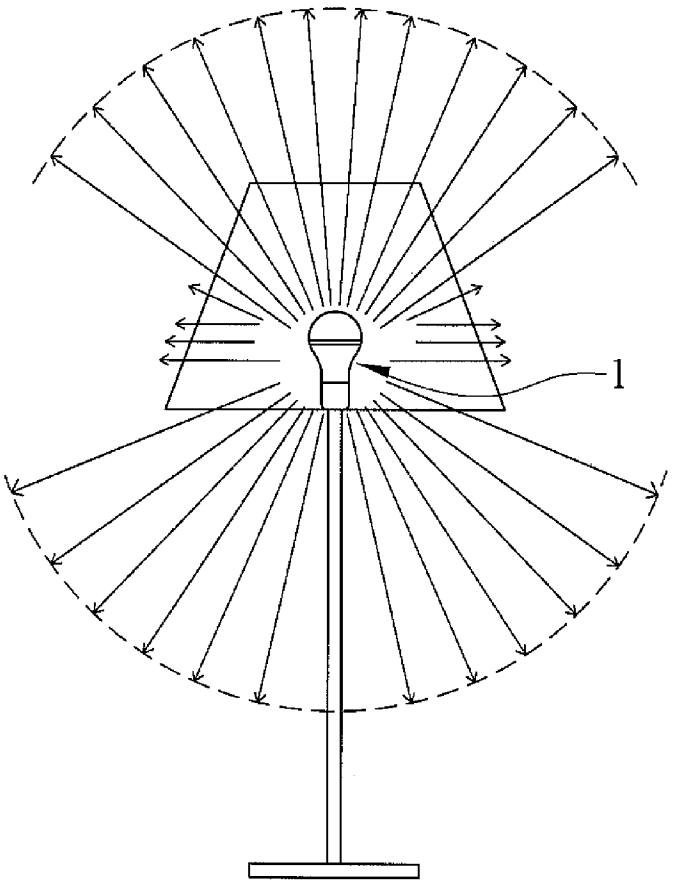
FIG. 16 is an illustration of projection light of the LED bulb of the present invention used in the standing lamp.
Figure 15:
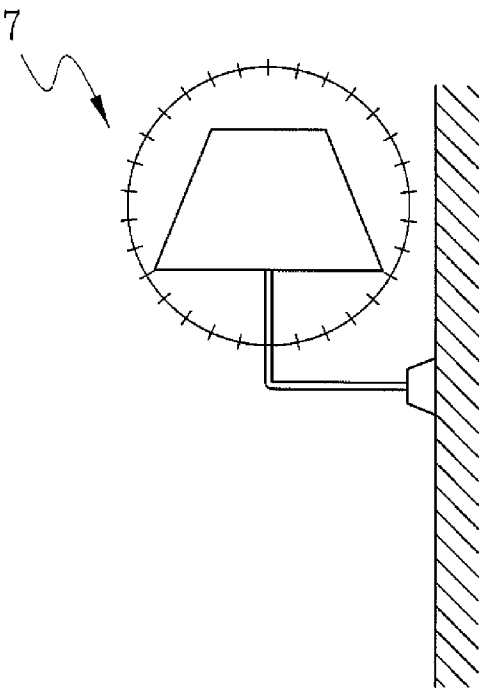
FIG. 15 shows a wall lamp and a 360-degree full emission angle projection of a LED bulb of the present invention used in the wall lamp.

In use, high illumination LED bulb 1 of each preferred embodiment of the present invention is adapted to be utilized in standing lamp 5 shown in FIG. 13, desk lamp 6 shown in FIG. 14, wall lamp 7 shown in FIG. 15 or a bed lamp. Further, FIG. 16 shows the projection light illustration of high illumination LED bulb 1 of the present invention used in standing lamp 5.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A high illumination LED bulb comprising, in combination:

a transparent lamp seat including spaced lower and upper ends, with a lamp head mounted to the lower end of the transparent lamp seat, with an opening formed in the upper end of the transparent lamp seat, with a driver mounted in the transparent lamp seat;

a transparent lampshade engaged with the upper end of the transparent lamp seat and covering the opening of the transparent lamp seat, with the transparent lampshade and the transparent lamp seat together defining a chamber;

a support board supported in the chamber and including an upper end face facing the transparent lampshade and a lower end face facing the lamp head;

a heat dissipating body received in the chamber and supported by the support board, with the heat dissipating body including an upper surface facing the transparent lampshade and a lower surface facing the lamp head;

a first light emitting module disposed on the upper surface of the heat dissipating body and including at least one first LED, with the first light emitting module electrically connected to the driver so that the at least one first LED can be driven to project light beams towards the transparent lampshade; and a second light emitting module disposed on the lower surface of the heat dissipating body and including at least one second LED, with the second light emitting module electrically connected to the driver so that the at least one second LED can be driven to project light beams towards the transparent lamp seat a first heat dissipating body disposed on the upper end face of the support board and a second heat dissipating body disposed on the lower end face of the support board.

2. The high illumination LED bulb according to claim 1, with the first light emitting module further including a first substrate mounted on the upper surface of the heat dissipating body, with the at least one first LED disposed on the first substrate, with the second light emitting module further including a second substrate mounted on the lower surface of the heat dissipating body, and with the at least one second LED disposed on the second substrate.

3. The high illumination LED bulb according to claim 2, with the support board being a transparent support board, with a ledge formed on an inner wall of the upper end of the transparent lamp seat, and with the support board mounted on the ledge.

4. The light illumination LED bulb according to claim 3, wherein the first substrate mounted on the first heat dissipating body, and the second substrate mounted on the second heat dissipating body.

5. The high illumination LED bulb according to claim 3, with the first substrate being integrally formed with the support board as a single member, and with the first substrate mounted on the ledge.

6. The high illumination LED bulb according to claim 3, with the second substrate being integrally formed with the support board as a single member, and with the second substrate mounted on the ledge.

7. The high illumination LED bulb according to claim 3, with the support board including a hole, and with the first substrate disposed in the hole of the support board.

8. The high illumination LED bulb according to claim 3, with the support board including a hole, and with the second substrate disposed in the hole of the support board.

* * * * *